US010781604B2

(12) United States Patent
York

(10) Patent No.: US 10,781,604 B2
(45) Date of Patent: Sep. 22, 2020

(54) VERTICAL SUPPORT MOUNTED UMBRELLA FRAME

(71) Applicant: Dareth L. York, San Tan Valley, AZ (US)

(72) Inventor: Dareth L. York, San Tan Valley, AZ (US)

( * ) Notice: Subject to any disclaimer, the term of this patent is extended or adjusted under 35 U.S.C. 154(b) by 214 days.

(21) Appl. No.: 16/046,950

(22) Filed: Jul. 26, 2018

(65) Prior Publication Data

US 2019/0032360 A1 Jan. 31, 2019

Related U.S. Application Data

(60) Provisional application No. 62/538,050, filed on Jul. 28, 2017.

(51) Int. Cl.

| | |
|---|---|
| ***E04H 15/28*** | (2006.01) |
| ***E04H 15/34*** | (2006.01) |
| ***A45B 11/00*** | (2006.01) |
| ***A45B 15/00*** | (2006.01) |
| ***A45B 23/00*** | (2006.01) |

(52) U.S. Cl.

CPC ..... *E04H 15/34* (2013.01); *A45B 11/00* (2013.01); *A45B 23/00* (2013.01); *A45B 2023/0006* (2013.01); *E04H 15/28* (2013.01)

(58) Field of Classification Search

CPC ..... A45B 23/00; A45B 25/02; A45B 25/10; A45B 25/14; A45B 25/18; A45B 2023/0006; A45B 2023/0012; A45B 2200/1009; E04H 15/04; E04H 15/26; E04H 15/28; E04H 15/34

USPC ..... 135/16, 19.5, 20.1, 28, 90, 98–99; 182/187

See application file for complete search history.

(56) References Cited

U.S. PATENT DOCUMENTS

| | | | | | |
|---|---|---|---|---|---|
| 3,004,542 | A * | 10/1961 | Moody | E04B 1/34823 | 135/97 |
| 4,364,193 | A * | 12/1982 | Visco | A01M 31/025 | 135/901 |
| 4,505,286 | A * | 3/1985 | Madion | A01M 31/02 | 135/117 |
| 4,739,785 | A * | 4/1988 | Poulson | E04H 15/001 | 135/117 |
| 4,922,942 | A * | 5/1990 | Schaeffer | E04H 15/04 | 135/90 |
| 5,131,496 | A * | 7/1992 | White | A01M 31/02 | 108/152 |
| 5,156,096 | A * | 10/1992 | Lamprey | A47B 96/027 | 108/108 |
| 5,218,982 | A * | 6/1993 | Kenji | E04H 15/04 | 135/90 |

(Continued)

*Primary Examiner* — Joshua E Rodden

(57) ABSTRACT

A device with a mounting band implement, wherein said mounting band implement is configured to support an upright structure on a vertical support. A tensioning device adjusts the tension of the mounting band implement. A vertical support bracket engages a portion of the mounting band implement, a fixed or adjustable rib section and angled support segment. A rib mounted angled support bracket engages angled support segment at the rib. An angled support segment is configured to maintain an angle for said rib section relative to the upright structure, in which the angled support segment includes a fixed or adjustable length segment that is operable for raising or lowering an angle of the rib section.

16 Claims, 3 Drawing Sheets

(56) References Cited

U.S. PATENT DOCUMENTS

| | | | | |
|---|---|---|---|---|
| 6,508,446 | B1 * | 1/2003 | Addison | A47D 13/105 182/187 |
| 6,698,440 | B2 | 3/2004 | Beyer et al. | |
| 7,182,091 | B2 * | 2/2007 | Maddox | A01M 31/025 135/90 |
| 7,516,707 | B2 * | 4/2009 | Schrot | A01M 31/02 108/152 |
| 8,360,083 | B2 * | 1/2013 | Anders, III | E04H 15/001 135/151 |
| 8,407,936 | B1 * | 4/2013 | Lee, Jr. | A47G 7/044 47/67 |
| 9,526,208 | B2 * | 12/2016 | Zamirpour | A01D 46/26 |
| 2010/0071997 | A1 * | 3/2010 | Green | A01M 31/02 182/187 |
| 2012/0175190 | A1 * | 7/2012 | Schlipf | A01M 31/02 182/187 |
| 2012/0199418 | A1 * | 8/2012 | Priest | A01M 31/02 182/129 |
| 2013/0186443 | A1 * | 7/2013 | Jeziorski | A01M 31/025 135/90 |
| 2014/0138185 | A1 * | 5/2014 | Samona | A01M 31/02 182/187 |
| 2016/0143264 | A1 | 5/2016 | Blaha | |

* cited by examiner

VERTICAL SUPPORT MOUNTED UMBRELLA FRAME

CROSS-REFERENCE TO RELATED APPLICATIONS

The present U.S. Utility patent application claims priority benefit of the U.S. provisional application for patent Ser. No. 62/538,050, entitled "A DEVICE FOR SUPPORTING AN UPRIGHT STRUCTURE FROM FALLING AND A CANOPY CONTRIVANCE", filed Jul. 28, 2017 under 35 U.S.C. 119(e). The contents of this related patent application is incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention may pertain to support structures. More particularly, certain embodiments of the invention relate to a support structure that may be mounted to an existing support.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that many individuals enjoy lying on a beach, hanging around a swimming pool or engaging in other activities that may involve being exposed to the elements such as, but not limited to, watching sporting events, relaxing in a park, hunting, picnicking, and fishing.

Elements to which such individuals may be exposed may include, without limitation, sun, rain, falling objects, insects, and wind. Some beaches or swimming pools have little to no shade or rain protection. Some beaches or swimming pools may have palm trees which may provide minimal protection from sun, rain, and falling objects depending on their size. It is further believed that other outdoor locations such as, but not limited to, sporting events, swap meets, carnivals, festivals, mountain retreats, ski resorts, water parks, soccer-baseball-football fields, lakefront parks, boating docks/piers or concert venues and parks may similarly lack shade or rain protection.

By way of educational background, an aspect of the related technology generally useful to be aware of is that there are some currently available approaches for providing protection from the sun, rain and other elements. Some such approaches are standard patio, market, or beach umbrellas. One can expect that if the frames of these umbrellas are not securely anchored, the umbrellas may be unstable and may become unusable in windy conditions. Other approaches may be attached to vertical supports. Such approaches may not provide full coverage or full protection from the elements such as, but not limited to, sun, rain, falling objects, privacy, and insects.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the FIGURES of the accompanying drawings and in which like reference numerals refer to similar elements and in which:

FIG. 1A is a diagrammatic side view of the support frame device mounted to a vertical or upright support structure. FIG. 1B is a side perspective view of one possible design of a vertical support bracket and one possible design of a rib mounted angle support bracket, and FIG. 1C is a side view of the support frame device in a partially collapsed configuration.

Figure 1A:
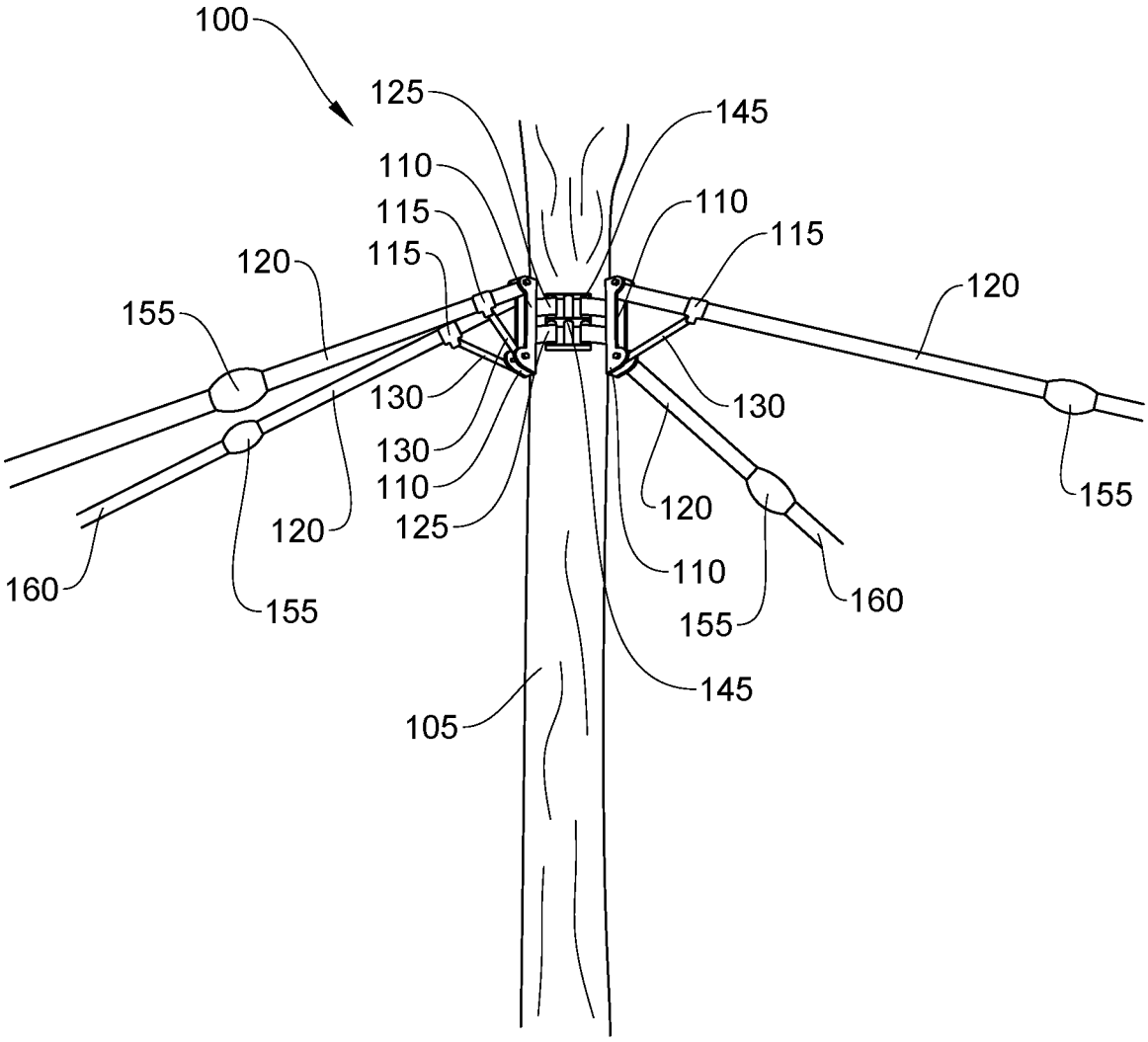
FIGS. 1A, 1B, and 1C illustrate aspects of an exemplary support frame device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed FIGURES and description set forth herein.

Embodiments of the invention are discussed below with reference to the FIGURES. However, those skilled in the art will readily appreciate that the detailed description given herein with respect to these FIGURES is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the FIGURES thereof, it is improper to rely upon the present written description, the FIGURES, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, in re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of" and "consisting essentially of" where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Figure 1B:
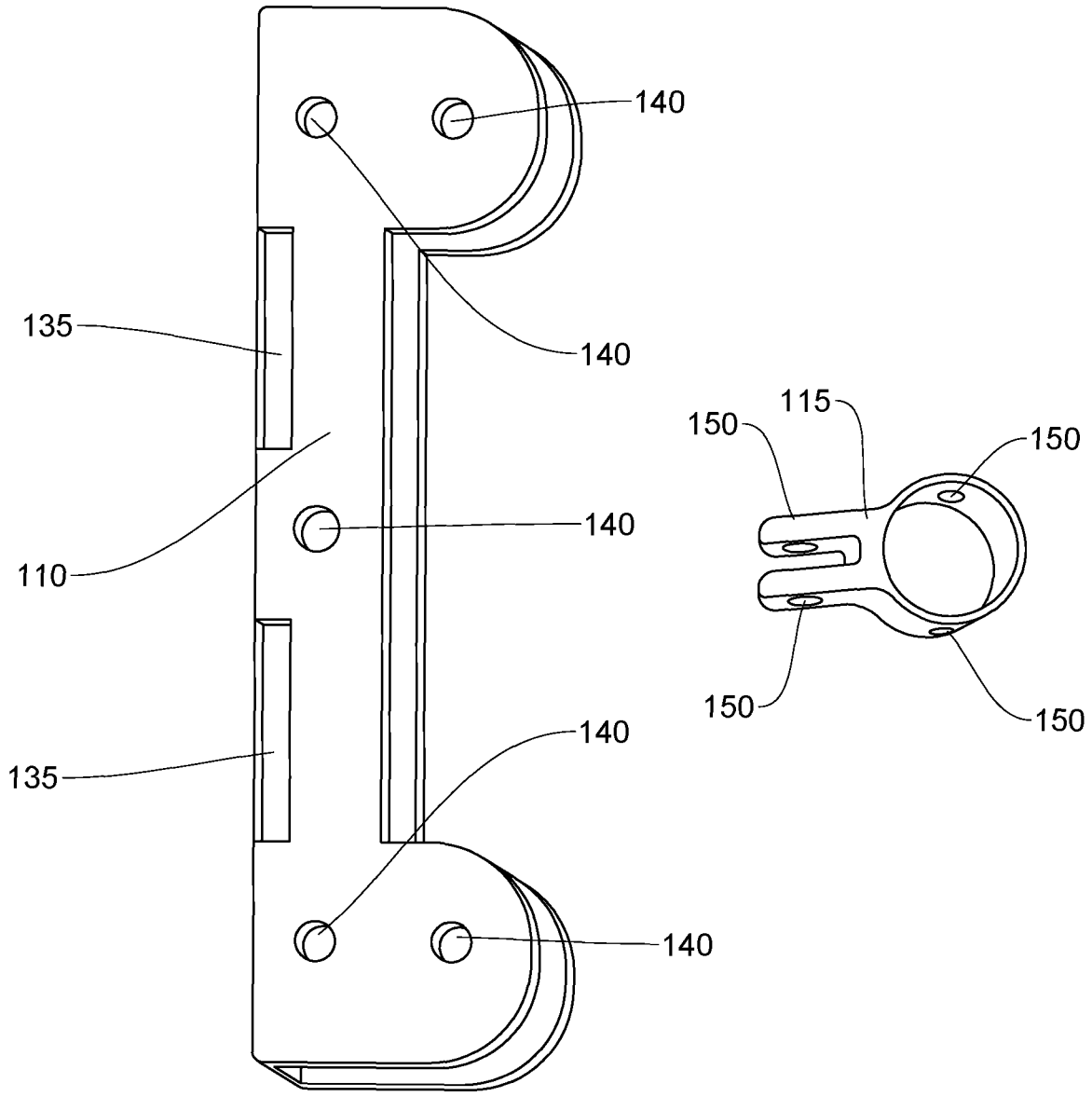
Figure 1C:
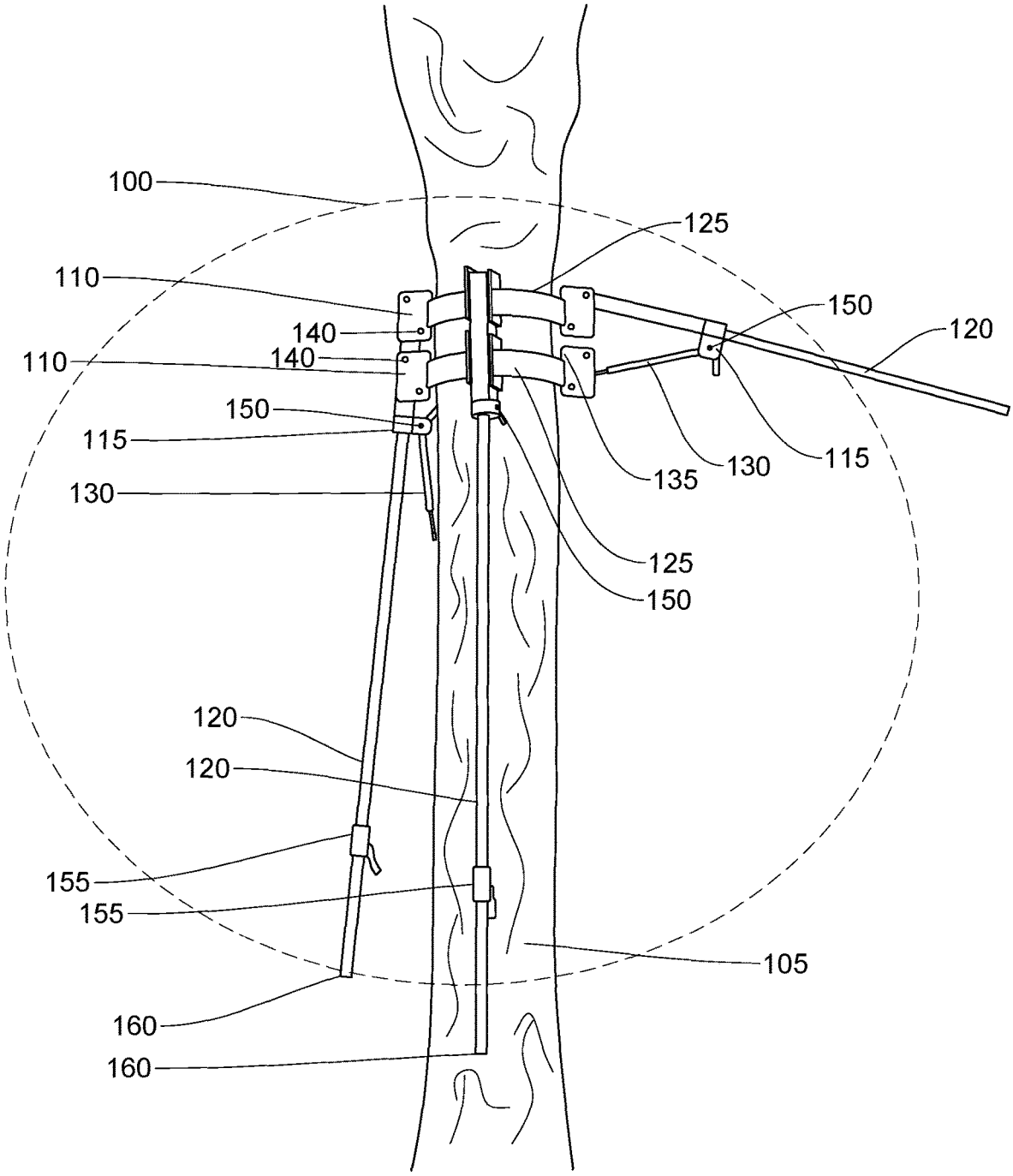

An embodiment of the present invention may provide a support frame that can mount to a fixed vertical or upright support such as, but not limited to, a tree, pole, post, column, or pillar. Some embodiments may be configured to do little to no damage to the vertical support. Moreover, some embodiments may comprise adjustable mounting means to accommodate vertical or upright supports with various different dimensions. FIGS. 1A, 1B, and 1C illustrate aspects of an exemplary support frame device 100, in accordance with an embodiment of the present invention. FIG. 1A is a diagrammatic side view of support frame device 100 mounted to a vertical or upright support 105. FIG. 1B is a side perspective view of one possible design of a vertical support bracket 110 and one possible design of a rib mounted angle support bracket implement 115, and FIG. 1C is a side view of support frame device 100 in a partially collapsed configuration. In the present embodiment, vertical or upright support 105 is illustrated by way of example as a tree. It is contemplated that vertical or upright support 105 may be a fixed or moveable vertical or upright support such as, but not limited to, a tree, pole, post, column, pillar, beam, telephone pole, light post, scaffolding, or any other suitable vertical support.

In some embodiments, vertical or upright support may be round (e.g. palm tree, pine tree or any other suitable tree, telephone/power pole, lamp post . . . ) with a approximate range of 8" diameter/25.13" circumference to 40" diameter/126.66" circumference. Vertical or upright support could be larger or smaller in size but may or may not need additional hardware/embodiments or constructed to different specifications to allow support frame to be used. Vertical or upright support shapes other then round can be accommodated with the use of different hardware/embodiments designed specifically for the shape. Vertical or upright support may be oriented at a certain angle with regards to the horizontal plane. Other possible vertical or upright supports could be goal post, fence post, power pole, building structural support column or frame (could technically be mounted on the side of a house, garage, shed, building with the use of the specifically designed hardware/embodiments for the size and shape of this application. Cost could/would be the limiting factor for the usage in this application. Could be mounted on anything with the correct shape and size dimensions. Could be specially designed to meet specific needs.

Support frame device 100 may comprise vertical support bracket(s) 110 (vertical support bracket could be 1 or more pieces). FIG. 1B shows one possible design of a 1 piece bracket and FIG. 1C shows one possible design of a 2 piece bracket in engagement with rib sections 120 (Ribs are horizontal supports). Rib/horizontal support is attached to the vertical support bracket with a fastener, including but not limited to, a pin, nut and bolt, or rivet. Vertical support bracket(s) may also be in engagement with one or more mounting band implement 125 and angled support segment 130. Referring to FIG. 1B, vertical support bracket(s) 110 may be flat on the back. In other embodiments the back portions of the vertical support bracket may have a proximate 90 degree angle for mounting on vertical supports with square corners or other shapes for mounting on specific types of vertical supports. In the present embodiment, vertical support brackets 110 may comprise one or more slot sections 135 and holes 140 that may be used as connection points for various elements of support frame device 100. For example, without limitation, mounting band implement 125 may be inserted into slot sections 135, and rib section 120 and angled support segment 130 may be connected to vertical support brackets 110 by fasteners through holes 140. Various different types of fasteners may be used to connect elements of support frame 100 such as, including but not limited to, nuts and bolts, screws, studs, locking mechanisms, rivets, pins, welding/bonding, or adhesive. In alternate embodiments such slots and holes may be placed in various different configurations. Other alternate embodiments may be implemented without such slots and holes, for example, without limitation, embodiments that are welded or glued together. Those skilled in the art will readily recognize, in light of and in accordance with the teachings of the present invention, that the frame device could consist of 1 or more vertical support brackets per rib section, vertical support brackets 110 can be made in virtually any size, shape/configuration or thickness and may be constructed from a multiplicity of suitable materials including, without limitation, various metals, plastics, composites or wood.

In some embodiments, vertical support bracket would be made from 316 stainless steel or similar material for strength and corrosion resistance. Could consist of one U shaped piece approximately 8"-20" long and approximately 1"-3" wide. Would have various slots and holes to accommodate various support hardware and mounting possibilities. Support brackets could be more than 1 piece and possibly be a shape other than U shaped and could be larger or smaller depending on application but may or may not need additional hardware/embodiments or rib modifications to mount to specific application. In alternative embodiments, vertical support brackets could be made from other materials including but not limited to steel, other grades of stainless steel, brass, titanium or any other metal, wood, fiberglass, carbon fiber, plastics, composites but may or may not have strength, corrosion resistance and cost effectiveness of the optimal 316 stainless steel.

Referring to FIG. 1A, vertical support brackets 110 may be mounted on vertical or upright support 105 by tightening mounting bands 125 around vertical or upright support 105 with the use of tensioning devices 145. It is contemplated that mounting band implement 125 may be made of various different materials such as, but not limited to, webbing, rubber strip, cable, chain, rope, metal strapping, or any other suitable material. It is further contemplated that tensioning devices 145 may be constructed from a multiplicity of suitable materials such as, but not limited to, metals, plastics or composites and various different types of tensioning devices may be used including, without limitation, ratcheting buckles, ratcheting slotted cam, cam buckles, over-center buckles, sliding buckles, winches, snaps, hook and loop material, gear and/or motor driven tensioning device(s), or specially machined parts that may include any or all parts of previous mentioned methods. In the present embodiment, support frame device 100 is shown with four vertical support brackets 110 and two mounting bands 125 each with one tensioning device 145. Depending on factors such as, but not limited to, the diameter of the vertical support, the size of the support frame device, and the size and type of item or items being supported by the support frame, some embodiments may be configured with various different numbers of vertical support brackets, mounting bands, and tensioning devices. For example, without limitation, some embodiments may be configured so that one tensioning device can adjust two or more mounting bands. Other embodiments may comprise multiple tensioning devices per mounting band. Yet other embodiments may comprise more or fewer vertical support brackets, usually one or two brackets per rib; however, more than two brackets may be used per rib in some implementations. Vertical support bracket(s) may comprise one (1) or more U shaped or other shaped pieces per rib. For instance, FIG. 1B shows 1 piece U bracket and FIG. 1C shows 2 piece U bracket. In some applications, vertical support brackets 110 may be mounted on vertical support 105 with mounting plates (or extension blocks) placed between vertical support brackets 110 and vertical or upright support 105. Mounting plates (or extension blocks) may be useful when space on or size of vertical support 105 is limited.

Those skilled in the art will readily recognize, in light of and in accordance with the teachings of the present invention, that other types of mounting means may be used in some embodiments. For example, without limitation, the vertical support brackets can be screwed, bolted onto or into or otherwise attached directly to the vertical support. Mounting band(s)/tension band(s)/belt(s) may comprise of Polyester webbing/strap for corrosion resistance and strength. Could be one or more pieces with a width of 1"-6" and 24"-144" long or longer depending on the size of the vertical support and number of vertical support brackets used. Mounting band width and length could be larger or smaller depending on application. Other materials may be used, but not limited to, webbing/strap of different materials, chain, rope, cable. Other possible vertical support bracket mounting methods could include, but are not limited to, C-Clamps, bar clamps, metal band clamp, barrel clamps, specially designed mounting collar, adhesives, extra large hose clamps, could be screwed or bolted onto or into vertical support. Some of these methods may do unnecessary damage to the vertical support.

In the present embodiment, rib section 120 may act as horizontal supports for items connected to or supported by support frame 100. For example, without limitation, if an umbrella canopy is connected to or supported by support frame 100, the canopy may rest on top of ribs 120, and ribs 120 may apply tension to the canopy. Canopy tension may be applied by various means including but not limited to (1) constructing fixed length rib 120 to a specific length based on dimensions of a specific vertical support 105 and canopy specifications (2) manually extending each adjustable rib 120 to desired length applying desired tension and using a rib adjusting device 155 to secure the rib (3) a spring could be inserted into or mounted onto each rib 120 that would apply a specific amount of tension per rib 120 (4) rib 120 could be constructed with a manual or power screw or hydraulic mechanism that could be inserted into or mounted onto each rib 120 that would extend or retract rib 120 to a desired length and apply a specific amount of tension. All methods may use a rib adjustment device 155 to secure each rib 120 to a desired length. It is contemplated that some embodiments may comprise more or fewer ribs. The number of ribs may, but not always, determine the shape of the support frame. For example, without limitation, a frame comprising four ribs may be used for a square or rectangle shape, a frame comprising six ribs may be hexagonal in shape and a frame comprising eight ribs may be octagonal in shape. It is contemplated that the frame may be virtually any shape or size and constructed from any suitable material(s), including but not limited to, fiberglass, woods, metals, composites or combination of materials. Furthermore, rib section 120 can be constructed from a multiplicity of suitable materials such as, but not limited to, wood, metal, carbon fiber, fiberglass, or a combination of suitable materials and be virtually any size, shape or thickness. Angled support brackets 115 may be connected to, mounted on or slide around each rib section 120 and secured with fastener(s) so that angled support segment 130 may connect rib section 120 to vertical support bracket 110 with fasteners to help support rib section 120 and provide and maintain a suitable angle for rib section 120. Again, using the non-limiting example of an umbrella canopy connected to or supported by support frame device 100, the proper angle for rib section 120 may help enable rain to run off the canopy while allowing air to flow under or through the canopy. It is contemplated that suitable angles for the ribs may vary in alternate applications. Referring to FIG. 1B, is one possible design for rib mounted angled support bracket 115 which may be connected to, mounted on or slide around each rib section 120 and connected to angled support segment 130 by fasteners in engagement with holes 150 in angled support brackets 115. Such fasteners may include, without limitation, nuts and bolts, screws, pins, studs, locking mechanism or rivets.

In other embodiments, the rib mounted angled support bracket may comprise of 316 stainless steel or similar material for strength and corrosion resistance. In additional embodiments, the rib mounted angled support bracket may comprise of at least one 0 shaped with ears or U shaped piece approximately 1"-3" long and approximately 1"-1.50" wide. Rib mounted angled support bracket could be shapes other then 0 or U shaped. It may have holes to accommodate support hardware and mounting possibilities. The rib mounted angled support bracket could be larger or smaller depending on application but may or may not need additional hardware/embodiments to mount to specific application. In some cases, the rib mounted angled support bracket may not be needed if angled support is configured to mount/connect directly to the rib with fastener(s). Other embodiments may comprise multiple slots and/or holes in the angled support bracket in various different configurations. In some embodiments the rib mounted angled support bracket may be attached using means other than fasteners in holes such as, but not limited to, welding, adhesive, or any other suitable connection method. In addition, rib mounted angled support brackets 115 can be constructed from a multiplicity of suitable materials including, without limitation, various metals, woods, composites, plastics, fiberglass, carbon fiber and be of virtually any size or shape. Some embodiments may comprise multiple rib mounted angled support brackets per rib or may have no rib mounted angled support brackets 115 and have angled support segment 130 mount/connect directly to rib section 120 by use of fasteners or other suitable method. Angled support segment 130 can be fixed or adjustable length. Adjustable angled supports 130 may use a variety of different methods of achieving the ability to adjust the length of angled supports 130 to raise and lower angle of ribs 120 including, without limitation, turnbuckles, threaded rods, telescoping pole/tube/rod assemblies, electrical solenoid screw assemblies, gear or motor driven assemblies, hydraulic assemblies, jack screws, shock absorbers, spring assemblies or hinges. The angled support may further comprise of adjustable turnbuckle and be made from 316 stainless steel for strength and corrosion resistance. The angled support may be approximately ⅜" in size and would adjust approximately 8"-20" in length. Other materials, sizes and configurations could be used. In some embodiments, angled support 130 could be larger or smaller in size and adjusted length depending on application. Could have multiple angled supports per rib 120.

Referring to FIG. 1C, in the present embodiment, one or more angled support segments 130 may be released from vertical support bracket 110 to enable rib sections 120 to fold down to create different rib configurations, or if winds become too high, for storage. Angled support segment 130 can be constructed from a multiplicity of suitable materials and may be various different sizes or shapes. Alternately, angled support segment 130 may be released from rib mounted angled support brackets 115 rather than from vertical support brackets 110 to collapse rib section 120, or angled support segment 130 may fold or adjust to a sufficiently short length to enable rib section 120 to be fully or mostly collapsed. A rib mounted angled support bracket that slides around rib section 120 may be used in place of a rib mounted angled support bracket connected to or mounted on rib section 120. The fastener holding the rib mounted angled support bracket that slides around rib section 120 may be removed allowing rib to be fully or partially collapsed without removing the angled support. In some embodiments, the ribs may not be collapsible. Referring to FIG. 1A, ribs 120 are shown with adjustment devices 155 that may enable the length of ribs 120 to be adjusted. Adjustability in ribs 120 may be accomplished by the use of two or more tubes or tube and rod combination(s) with different diameters, where the tubes or rods with smaller diameters may be inserted into the tubes with larger diameters in a telescoping manner. Adjustment devices 155 may be used to secure the tubes or tube and rod once the desired length for ribs 120 are achieved. It is contemplated that various different securing means may be used for adjustment devices 155 including, without limitation, quick clamps, locking collets, telescoping tube locks, clutch tube lock, cam tube lock, spring button lock, snap button lock, threaded couplers, slits in ribs with clamps, screws, or pins, or any other suitable method. Some embodiments may comprise multiple adjustment devices 155 per rib 120. Moreover, adjustment devices can be made in various different sizes and shapes and may be constructed from a wide variety of suitable materials such as, but not limited to, metals, composites, woods or plastics.

Ribs 120 could be fixed length comprising one or more sections joined to a fixed length or be adjustable length comprising two more sections with rib adjusting device(s) 155. An adjustable length rib may comprise two or more different sized tubes or tube and rod combination(s) and be made from fiberglass for strength and lighter weight. The tube(s) or tube and rod combination(s) of approximate sizes of 1.25" and 1" diameters and adjust in length from approximately 5'-8' (could be round, square, octagon or any other shape tubes/rods). The 1" tube or rod is inserted into 1.25" tube and length is secured with a adjustment device 155 or other similar device. The tube(s) and or rod sizes could be larger or smaller diameter and length may be longer or shorter depending on the application. Having adjustable ribs gives greater flexibility with respect of having the ability for a single frame to mount on multiple sizes of vertical supports. Not quite one size fits all but close. The ribs would normally mount to vertical support bracket with a fastener through the mounting hole(s) located on the vertical support and mounting holes on end of the rib (nut and bolt, pin or rivet . . . ). Other embodiments to mount ribs onto vertical support brackets could include a fitting, flange, collar, adaptor, quick connect/disconnect, tab connected to and extends from end of rib or similar device that would allow rib to be different sizes or shapes then optimal. Rib mounting fitting, flange, collar, adaptor, quick connect/disconnect, tab connected to and extends from end of rib or similar device could also make possible the use of smaller vertical supports and vertical support brackets where space is limited. Rib mounting fitting, flange, collar, adaptor, quick connect/disconnect, tab connected to and extends from end of rib could be made from various materials including but not limited to metals, woods, composites, plastics or any other suitable materials and be attached to the rib by various methods bonding, rivet, pins screws nut and bolts or any other suitable method. Rib mounting fitting, flange, collar, adaptor, quick connect/disconnect, tab connected to and extends from end of rib or similar device could be constructed in various shapes or sizes depending on application.

Some embodiments may be implemented with rib sections of fixed length rather than adjustable ribs. A fixed length rib 120 is possible if exact size of vertical support is known. In the present embodiment rib end caps 160 or rib ends that could be different sizes and shapes that may be placed at top and/or bottom end of each rib section 120 to plug the holes or cap the end(s) of rib section 120 or make a more stable and supportive connection point between end of rib top and/or bottom and support frame or canopy rib pocket if applicable. Rib end caps 160 may also provide support for items that may have pockets that slide over ribs 120 to be held in tension such as, but not limited to, umbrellas or canopies. Rib end caps or plugs 160 could also have holes, hooks or other configurations to hold and give extra support at connection points or other items that may be mounted at the rib ends. Rib ends 160 can be constructed from various different materials such as, but not limited to, plastic, metal, wood, composites, or rubber and may be made in a multiplicity of suitable sizes, shapes, and colors.

One method for installing support frame device 100 on a vertical or upright support 105 may be as follows. First, a user may decide on a location and vertical support 105 to which to mount support frame 100. User does calculations based on size of vertical support 105 to determine proper placement of vertical support brackets 110. Then the user may wrap mounting band implement(s) 125 with attached tensioning device(s) 145 and connected vertical support brackets 110 around vertical or upright support 105, placing vertical support brackets 110 in locations near the desired end locations based on previous calculations. Depending on various factors including, without limitation, the configuration and specifications of the item or items to be connected to support frame 100 and the desired configuration of rib sections 120, the number and placement of vertical support brackets 110 may vary in different applications. Once vertical support brackets 110 are approximately positioned, tensioning device(s) 145 may be used to apply enough tension to mounting band implement(s) 125 to hold vertical support brackets 110 to vertical or upright support 105. Mounting band implement(s) 125 may be left slightly loose at this point to allow for some movement of vertical support brackets 110 for fine tuning of the positioning of vertical support brackets 110. Once mounting band implement(s) 125 and vertical support brackets 110 are in the desired final positions, tensioning device(s) 145 may be further tightened to firmly secure support frame device 100 to vertical or upright support 105. Rib section(s) 120 and angled support segment(s) 130 may then be connected to vertical support brackets 110 and angled support segment 130 may be connected to rib mounted angled support bracket(s) 115 or could be configured to connect directly to rib 120. In some implementations rib section(s) 120 may be connected to vertical support brackets prior to installation on vertical support 105. If angled support segments 130 are adjustable, angled support segments 130 may then be used to adjust the angle of each rib section 120. In addition, if the length of rib section 120 is adjustable, rib adjustment devices 155 may be used to adjust the length of each rib section 120. Once the desired positioning of rib section 120 is achieved, the item or items to be supported by support frame device 100 may be installed on support frame 100. Additional adjustments may be made to angled support segment 130 and rib adjustment devices 155 after installation as desired. When installed in this manner, support frame device 100 typically does little or no damage to vertical or upright support 105.

In typical use of the present embodiment, support frame 100 may be used to support an umbrella or canopy to provide shade from the sun, protection from rain or falling objects, privacy, insect protection, etc. Due to proposed links between sun exposure and skin cancer, one may expect that protection from the sun may be particularly desirable. As previously described, vertical support 105 on which support frame 100 may be mounted may be a tree, a pole, a post, a column, a pillar, a beam, etc. One may expect that the use of vertical or upright support 105, which is not permanently attached to support frame 100 and is typically fixed in location, may enable support frame 100 to be more portable, more stable, and less likely to be effected by wind than currently available approaches such as, but not limited to, market, patio, or beach umbrellas. In addition, support frame 100 may be configured to encircle the entire vertical support 105 to provide up to 360 degrees of coverage and protection from the elements around vertical support. Moreover, with the use of mounting band implements 125 and tensioning devices 145, adjustable rib section 120 with installed adjustment devices 155, support frame device 100 may be adjustable in circumference to adapt to multiple sizes of vertical or upright supports 105. It is contemplated that some embodiments may be custom made to fit on specific vertical or upright supports.

Various embodiments of the present invention may be used in a variety of locations where suitable vertical supports are present to accommodate the mounting of the support frame including, without limitation, beaches, swimming pools, lakes, mountains, parks, backyards, civic centers, tree lined streets, hotels and resorts, concert venues, outdoor restaurant seating areas, worksites, outdoor marketplaces, bus stops, parks, and playgrounds. In some embodiments in which the frame supports a canopy, panels of fabric or other materials may hang down from the canopy to form walls. Such embodiments may be used by beachgoers for changing clothes, privacy and/or to protect from insects. In addition some such embodiments may be used by hunters as a hunter's blind.

Those skilled in the art will readily recognize, in light of and in accordance with the teachings of the present invention, that support frames in some embodiments may be used to support items other than canopies and for uses other than shelter from the elements. For example, without limitation, clotheslines may be strung between the ribs of the frame to form a drying rack. Various other items may also be hung on the ribs of a support frame for various applications such as, but not limited to, flags, wind chimes, hanging plants, bird feeders, and irrigation systems. By adding or removing various components of the support frame, some embodiments may be configured for a multiplicity of suitable applications. For example, without limitation, in some embodiments, the ribs and angled supports may be removed so that the vertical support bracket(s) and the mounting band may be used to connect various different types of mounting hardware to a vertical support such as, but not limited to, hooks, pins, rivets, nuts and bolts, carabineers, clamps, and brackets. This mounting hardware may then be used to mount a wide variety of objects to the vertical support or between two or more vertical supports including, without limitation, clotheslines, amateur radio antennas, hammocks, swings, and sports nets. It is contemplated that additional features can be added to the support frame in some embodiments such as, but not limited to, solar, battery powered, or wired lights, misting systems, fans, hooks for towels, and pockets made from a netting or fabric that is supported by the frame to be used for storage where clothes, valuables, or other personal items may be stowed. In some embodiments a locking system could be added to make items attached to or stored on the frame more secure from theft. The support frame can have any number of ribs, support brackets, mounting band implements and tensioning devices and can be virtually any size, virtually any shape, and constructed from almost any suitable materials.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a support structure that may be mounted to an existing support according to the present invention will be apparent to those skilled in the art. Various aspects of the invention have been described above by way of illustration, and the specific embodiments disclosed are not intended to limit the invention to the particular forms disclosed. The particular implementation of the support structure may vary depending upon the particular context or application. By way of example, and not limitation, the support structures described in the foregoing were principally directed to implementations in which support structures are mounted to vertical supports; however, similar techniques may instead be applied to support structures that may be mounted to horizontal or angled supports such as, but not limited to, porch banisters, other types of railings, fencing, and tree branches, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

at least one mounting band implement, wherein said at least one mounting band implement is configured to be mounted to a portion of an upright support structure;

at least one tensioning device, wherein said at least one tensioning device is operable for applying tension to said at least one mounting band implement;

at least three vertical support brackets that are each configured to engage said at least one mounting band implement;

at least three ribs configured to attach to said at least three vertical support brackets with a rib section fastener coupled to each of said at least three ribs, wherein each of said at least three ribs comprises at least one of a fixed length rib formed of a rod or tube, and an adjustable length rib formed of two or more tubes or a tube and rod combination operable for enabling a length of said adjustable length rib to be adjusted;

at least three angled support segments that are each configured to support and maintain a predetermined angle for said at least three ribs;

at least three rib mounted angled support brackets each configured to engage said at least three angled support segments to said at least three ribs and to said at least three vertical support brackets; and in which said at least three angled support segments comprises a fixed or adjustable length segment that is operable to raise or lower an angle of said at least three ribs said at least three vertical support brackets.

2. The device of claim 1, further comprising a rib end implement that is configured to at least one of:

a) to give support for attached devices at at least one of a top end and a bottom end of one of the at least three ribs, b) to plug or cap end portions of said at least three ribs, c) to stabilize a transition point between the top end and the bottom end of one of the at least three ribs, d) to support connection points at support brackets on the top end, and e) to fit into a rib end pocket on an umbrella canopy at the bottom end.

3. The device of claim 2, in which said top end or said bottom end comprises at least a contrivance that is configured to hold or support items mounted at said respective top end or bottom end.

4. The device of claim 3, in which said upright support structure is a tree or a post.

5. The device of claim 4, in which said mounting band implement comprises at least one of a webbing belt, a rubber strip, a cable, a chain, a rope and metal strapping.

6. The device of claim 1, in which said rib section fastener comprises at least one of a pin, nut and bolt and a rivet.

7. The device of claim 6, in which said at least three vertical support brackets comprises one or more slot sections configured to engage with said at least one mounting band implement, wherein said at least one mounting band implement is inserted in said one or more slot sections.

8. The device of claim 7, in which said at least three vertical support brackets further comprises at least two hole constituents configured to engage with at least one of the at least three ribs and said at least three angled support segments by vertical support bracket fasteners.

9. A device comprising:

at least one mounting band implement, wherein said at least one mounting band implement is configured to support a structure on an upright support;

at least one tensioning device, wherein said at least one tensioning device is operable for adjusting tension of said mounting band implement;

at least three vertical support brackets engaged to a portion of said mounting band implement;

at least three rib sections, in which said at least three rib sections each comprises at least one of a fixed length rod or tube and an adjustable length rib;

at least three angled support segments that are each configured to maintain a predetermined angle for one of said at least three rib sections;

at least three rib mounted angled support brackets that are each configured to engage one of said at least three angled support segments to one of said at least three rib sections; and in which said at least three angled support segments comprises a fixed or adjustable length segment that is operable for raising or lowering an angle of said at least three rib sections with respect to said at least three vertical support brackets.

10. The device of claim 9, further comprising a rib end cap or plug implement that is configured to plug the holes in or add support on at least one of a top end portion and a bottom end portion of one of said at least three rib sections.

11. The device of claim 10, further comprising at least a support or a contrivance operable for holding or supporting items mounted at said rib end cap or plug implement.

12. The device of claim 11, in which said upright support structure is a tree or a post.

13. The device of claim 9, in which said at least three vertical support brackets comprise at least one slot section configured to engage with said at least one mounting band implement, wherein said at least one mounting band implement is inserted in said at least one slot section.

14. The device of claim 13, in which said at least three vertical support brackets further comprises at least two hole constituents configured to engage with at least one of said at least three rib sections and said at least three angled support segments by vertical support bracket fasteners.

15. The device of claim 1, further comprising at least three adjustment or clamping devices each mounted to a respective one of the at least three ribs and configured to secure the respective one of the at least three ribs at a predetermined adjusted length when the at least three ribs are each adjustable length ribs.

16. The device of claim 9, further comprising at least three adjustment or clamping devices each mounted to a respective one of the at least three rib sections and configured to secure the respective one of the at least three rib sections at a predetermined adjusted length when the at least three rib sections are each adjustable length ribs.

* * * * *